United States Patent [19]

Kuhlmann et al.

[11] 4,453,500

[45] Jun. 12, 1984

[54] COOLED TUBE WALL FOR METALLURGICAL FURNACE

[75] Inventors: Herbert Kuhlmann, Bochum; Kurt Rieger, Bottrop, both of Fed. Rep. of Germany

[73] Assignee: Sidepal S.A., Luxembourg, Luxembourg

[21] Appl. No.: 378,250

[22] Filed: May 14, 1982

[30] Foreign Application Priority Data

Jan. 27, 1982 [DE] Fed. Rep. of Germany ..... 3202574

[51] Int. Cl.[3] ..... F22B 37/24

[52] U.S. Cl. ..... 122/510; 122/511; 122/6 A; 122/235 C

[58] Field of Search ..... 122/6 A, 235 A, 235 C, 122/235 K, 510–512

[56] References Cited

U.S. PATENT DOCUMENTS

| | | | |
|---|---|---|---|
| 571,762 | 11/1896 | Hayes | 122/511 |
| 697,560 | 4/1902 | Steinmetz | 122/511 |
| 1,043,634 | 11/1912 | Shepherd | 122/235 C |
| 1,109,627 | 9/1914 | Belleville | 122/235 C |
| 1,132,458 | 3/1915 | Belleville | 122/235 C |
| 1,223,108 | 4/1917 | Radiguer | 122/235 C |
| 1,736,882 | 11/1929 | Jackson | 122/6 A |
| 1,814,555 | 7/1931 | Jacobus et al. | 122/235 A |
| 1,988,217 | 1/1935 | Sayles | 122/511 |
| 3,108,576 | 10/1963 | Michel | 122/6 A |

FOREIGN PATENT DOCUMENTS

| | | | |
|---|---|---|---|
| 2390692 | 1/1979 | France | 122/235 |

*Primary Examiner*—Henry C. Yuen

*Attorney, Agent, or Firm*—Karl F. Ross; Herbert Dubno

[57] ABSTRACT

A tube wall for a metallurgical furnace is mainly formed by an array of generally parallel tubes centered on respective tube axes and each having two widened open tube ends one of which projects laterally from the respective tube in one radial direction and the other of which projects laterally from the respective tube in the opposite radial direction. Each tube end laterally engages the tube end of an adjacent tube and the tubes are laterally spaced between their ends. Respective caps each cover two adjacent tube ends and interconnect same so that the interiors of the tubes and caps form a sinuous passage. Finally, respective welds secure the tube ends and caps together hermetically to seal off the passage. Thus appropriate means can circulate a coolant through the array. Such construction is sufficiently rigid to do away with webs laterally interconnecting the tube sections, thereby eliminating the cost of their manufacture and installation.

5 Claims, 5 Drawing Figures

COOLED TUBE WALL FOR METALLURGICAL FURNACE

FIELD OF THE INVENTION

The present invention relates to a metallurgical furnace. More particularly this invention concerns a cooled tube wall for an electric-arc furnace or the like.

BACKGROUND OF THE INVENTION

It is known to provide coolable tube walls for metallurgical vessels or furnaces that allow the lining to be kept relatively cool, that is as compared to the high refining or other treatment temperatures, and hence rigid. Such systems normally have a succession of laterally spaced straight tube sections joined at their ends by reverse bends or full 180° elbows, and joined laterally by rigid webs that form of the tube wall a rigid self-supporting structure. The bends have a radius of curvature which determines the spacing of the tubes, and the width of the webs. A cooler is connected to such an assembly to pass a coolant such as water or steam through it.

The fabrication of such a tube wall is an extremely complex procedure, involving meticulous interfitting of the various parts and then welding them together along seams that run the full length of each tube section, between it and the adjacent web plate and annularly around each tube end and the respective end of the reverse-bend coupling. Thus each tube has two annular welds connecting it to the respective reverse bends, and two full-longitudinal welds connecting it to the respective webs, with yet another semicircular weld extending as a continuation of the respective full-longitudinal weld between each web end and the inside of the respective reverse bend. Obviously all such welds must be carefully inspected, particularly where they cross, a location where the second weld is liable to weaken the first.

Even the most carefully made such structure is subjected to great stresses from thermal expansion and contraction, due principally to the difference in temperature between the interconnecting webs and the tubes themselves. The webs are, obviously, much warmer than the tubes, so that the welds between them and the tubes are under enormous strain. Since these welds are very long, it is possible for the stresses between the relatively hot tubes and relatively cool webs to be therefore effective in turn along the entire tube length, placing the system under great strain.

In addition such systems are problematic because these long weld seams along the walls of the tubes slightly weaken these tubes in this region. Thus it is necessary to make the tubes of stock which is sufficiently thick to withstand the considerable pressures it will be subject to in use, even though such thickness is only needed at the weakened weld regions. In other words, if it were not for these webs it would be possible to make the tube sections of substantially lighter stock, rated purely for the pressure they will have to withstand, without allowing for the weakening caused by welding the webs to them.

OBJECTS OF THE INVENTION

It is therefore an object of the present invention to provide an improved tube wall.

Another object is the provision of such a tube wall which overcomes the above-given disadvantages.

A further object is to provide a tube-wall assembly for a metallurgical furnace, in particular an electric-arc furnace, which can be manufactured simply and cheaply, yet which will have a service life at least as long as the more difficult to manufacture prior-art ones.

SUMMARY OF THE INVENTION

These objects are attained according to the instant invention in a tube wall for a metallurgical furnace which is mainly formed by an array of generally parallel and straight tubes centered on respective tube axes and each having two widened open tube ends one of which projects laterally from the respective tube in one radial direction and the other of which projects laterally from the respective tube in the opposite radial direction. Each tube end laterally engages the tube end of an adjacent tube and the tubes are laterally spaced between their ends. The tube ends are open axially, not radially or laterally. Respective caps each cover two adjacent tube ends and interconnect same so that the interiors of the tubes and caps form a sinuous passage. Finally, respective welds secure the tube ends and caps together hermetically to seal off the passage. Thus appropriate means can circulate a coolant through the array.

Such constructions is sufficiently rigid to do away with the webs, thereby eliminating the cost of their manufacture and installation. As a result production costs are greatly reduced. Furthermore thinner-walled tube sections can be used, since the tubes are not welded between their ends with the concomitant wall weakening. Thus according to this invention the caps are of greater wall thickness than the tubes.

According to another feature of this invention the array is received in a support wall provided with anchors engaging the tubes generally at the weld between the tube ends and wholly supporting the array.

Such a support wall may itself be formed of or have a lining of refractory material suspended by the anchors from the support wall. In most cases the array is upright and the anchors are hooks engaged up underneath the upper caps.

The tube ends according to this invention are welded together for fluid flow between the tubes at the tube ends as well as at the caps. These caps in turn are rounded and form smooth continuations of the respective tube ends.

The tubes according to this invention are substantially cylindrically tubular between their widened ends. The ends in turn have flat planar outer faces parallel to the respective axes. Thus the outer faces of each of the tubes flatly engage the respective outer faces of the flanking tubes. Such a connection is extremely strong, as the welds include respective generally U-shaped weld lying in a plane parallel to the respective axes and extending along the edges of the flatly engaging outer faces of the tubes. Even though there is a double wall thickness at the junction formed by each pair of joined faces, the temperatures here will be the same, as the wall forming each such face will have one side exposed to the temperature of the liquid in the passage and the other side against the corresponding side of the other wall which is similarly heated.

The vessel therefore has a normally metallic outer wall provided with inwardly projecting support hooks on which the tube-wall assembly and refractory lining is hung. The tube-wall itself purely serves a coolling function, does not hold in the melt, which task is adequately preformed by the combination of the refractory mold lining and the solid outer wall. The vessel lining or wall therefore carries the lining-support hooks, so that they do not have to be secured to the tubes or caps, an operation that would only weaken them. These hooks also serve to hold the tube-cap array in place.

Eliminating the webs also greatly reduces the thermally caused stresses in the tube wall. Since the tubes and caps are heated to the same extent and are usually of the same steel, they will swell and shrink as they are heated and cooled to the same extent. There are no cooler ribs that will be less thermally expanded.

DESCRIPTION OF THE DRAWING

The above and other features and advantages will become more readily apparent from the following, reference being made to the accompanying drawing in which.

SPECIFIC DESCRIPTION

Figure 1:
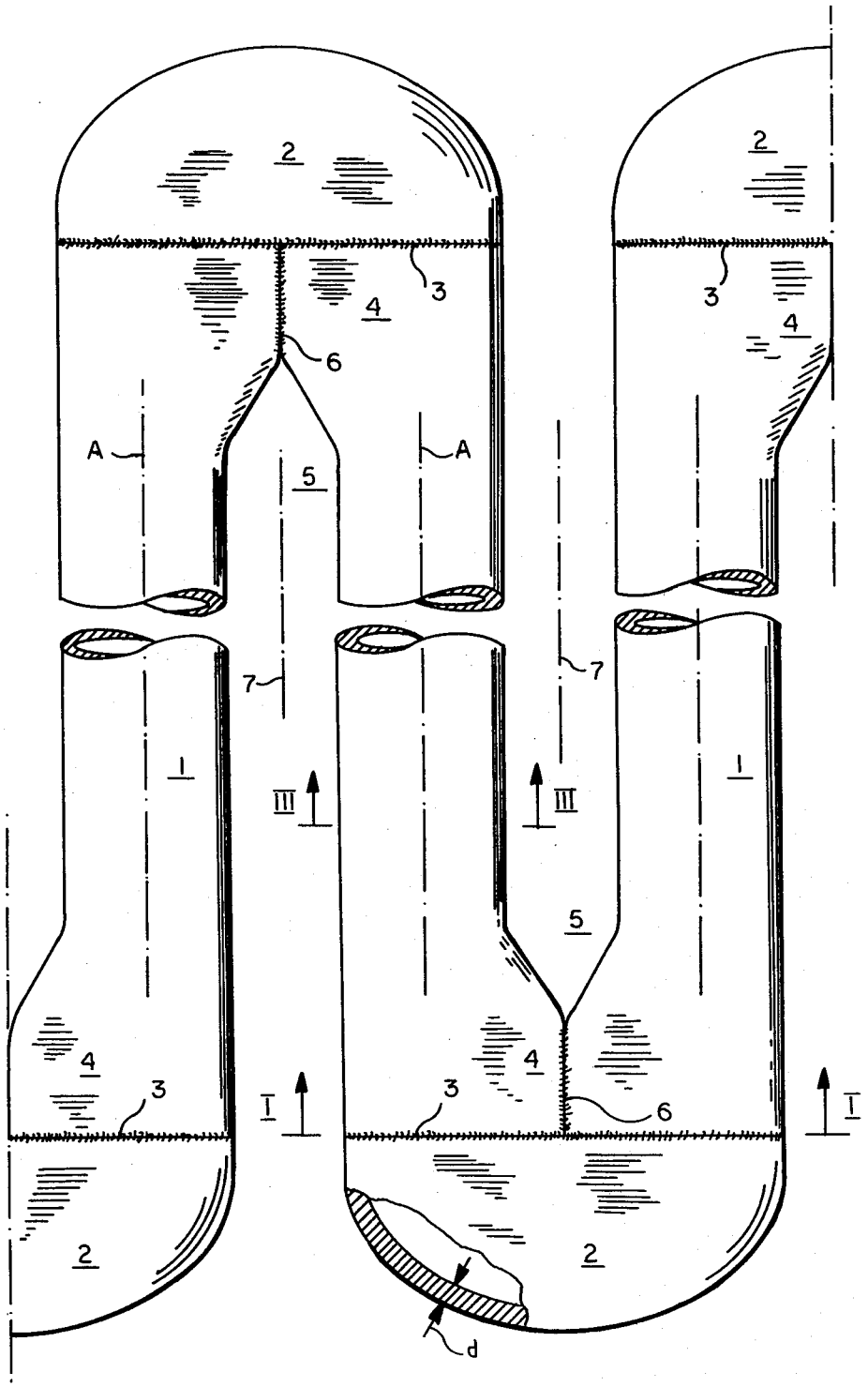
FIG. 1 is a large-scale side view, partly broken away, showing the wall tube system of this invention.

As seen in the drawing a cooled tube wall has a multiplicity of like tubes 2 centered on respective upright parallel axes A and formed with enlarged ends 4 joined together by coupling caps 2. The enlarged ends 4 are welded to the caps 2 along a planar and annular seam 3 and to each other along a U-shaped seam 6 perpendicular thereto but parallel to the respective axis A. To this end each of the widened ends 4 has a flat face 12 parallel to the respective axis A and flatly engaging the respective such flat face 12 of the respective end 4 of the adjacent tube 1, so that the tubes 1 bear in flat surface contact against each other and are solidly connected together by a seam extending along a plane perpendicular to the direction of stress urging them apart.

Figure 4:
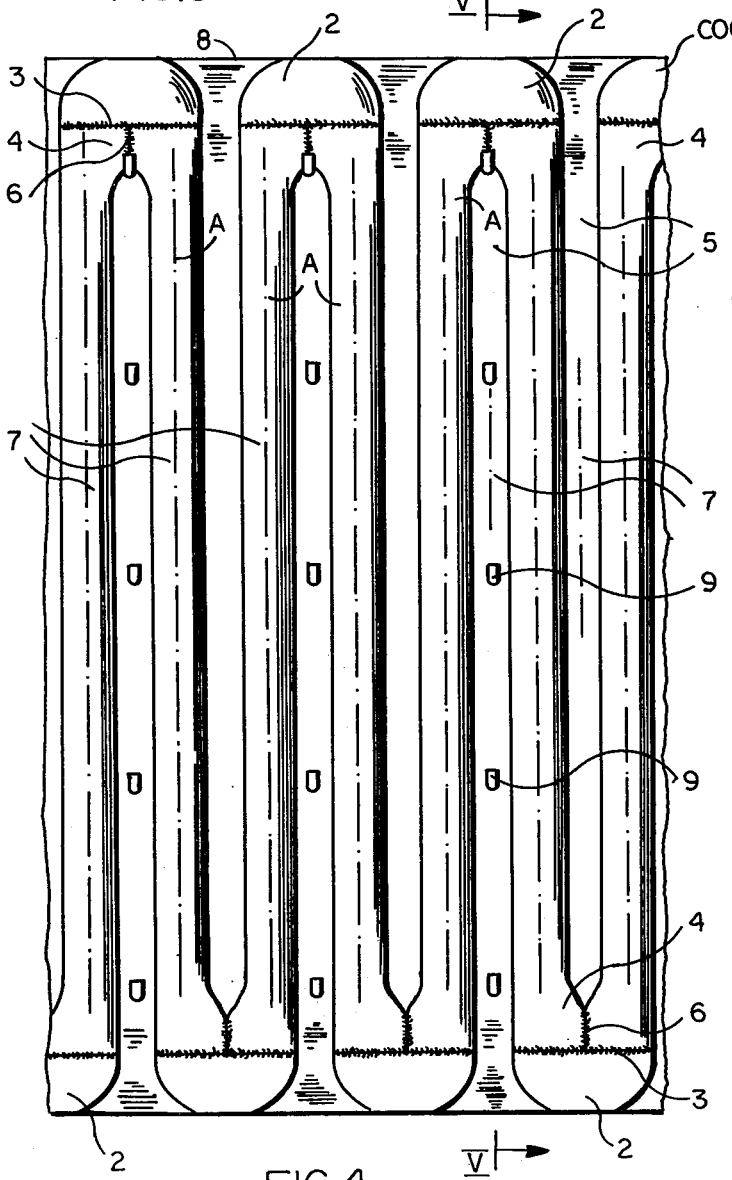
FIG. 4 is a small-scale side view showing the assembly of this invention installed.
Figure 5:
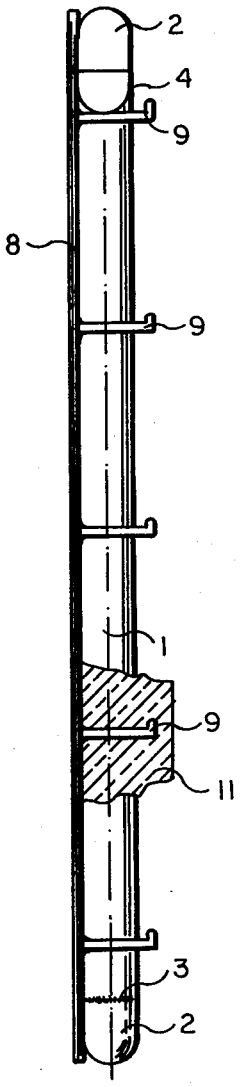
FIG. 5 is a section taken along line V—V of FIG. 4.

The enlarged ends 4 project from opposite sides of the respective tube sections 1 to form between each tube section 1 and the adjacent tube sections 1 gaps 5 having centerlines 7 parallel to the tube axes A. This type of construction, with open spaces between the tubes 1, allows the self-supporting assembly formed by the sections 1 and caps 2 to be suspended from conventional anchor hooks 9 of a furnace wall or furnace-lining wall 8 shown in FIGS. 4 and 5. Otherwise these hooks 9 serve to hold on the furnace lining or slag shown only partially at 11 in FIG. 5.

Figure 3:
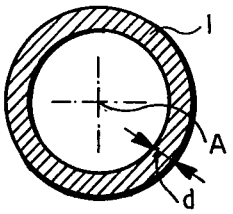
FIGS. 2 and 3 are sections taken along lines II—II and III—III of FIG. 1, respectively.
Figure 2:
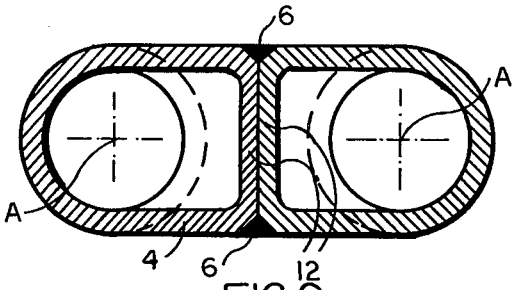

A cooler 10 including a pump circulates water or steam through the meander formed by the sections 1 and caps 2 in a manner well known in the art. The caps 2 have a wall thickness d (FIG. 1) which is somewhat greater than the wall thickness d' (FIG. 3) of the tube sections 1 and end portions 4 so that the arrangement is very rugged.

We claim:

1. A tube wall for a metallurgical furnace, said wall comprising:

an array of generally parallel tubes centered on respective tube axes and each having two widened axially open tube ends one of which projects laterally from the respective tube in one radial direction and the other of which projects laterally from the respective tube in the opposite radial direction, each tube end laterally engaging the tube end of an adjacent tube, said tubes being laterally spaced between said ends respective caps each covering two adjacent tube ends and interconnecting same, whereby the interiors of said tubes and caps form a simuous passage;

respective welds securing said tube ends and caps together hermetically to seal off said passage;

means for circulating a coolant through said array;

a support wall on one side of said array provided with anchors engaging said tubes generally at the weld between said tube ends and wholly supporting said array said array being upright and said anchors being hooks engaged up underneath the upper caps;

additional anchors on said support wall projecting through spaces between said tubes; and a lining of refractory material suspended by said anchors from said support wall, said widened ends having flat planar outer faces parallel to the respective axes, the outer faces of each of said tubes flatly engaging the respective outer faces of the flanking tubes, said welds including respective generally U-shaped welds lying in a plane parallel to the respective axes and extending along the edges of the flatly engaging outer faces of said tubes.

2. The metallurgical-furnace tube wall defined in claim 1 wherein said caps are of greater wall thickness than said tubes.

3. The metallurgical-furnace tube wall defined in claim 1 wherein said tube ends are welded together for fluid flow between said tubes at said tube ends via said caps.

4. The metallurgical-furnace tube wall defined in claim 3 wherein said caps are rounded and form smooth continuations of the respective tube ends.

5. The metallurgical-furnace tube wall defined in claim 1 wherein said tubes are substantially cylindrically tubular between their said ends.

* * * * *